US006065440A

United States Patent [19]

Pasquan

[11] Patent Number: 6,065,440

[45] Date of Patent: May 23, 2000

[54] INTERNAL COMBUSTION ENGINE WITH BINARY CYLINDER SIZING FOR VARIABLE POWER OUTPUT

[76] Inventor: Raymond F. Pasquan, 11 Putney Rd., Etobicoke, Ontario, Canada, M8W 2K6

[21] Appl. No.: 09/348,577

[22] Filed: Jul. 7, 1999

[51] Int. Cl.[7] ..... F02B 77/00

[52] U.S. Cl. ..... 123/198 F

[58] Field of Search ..... 123/198 F, 481, 123/55.5, 55.7, 55.3

[56] References Cited

U.S. PATENT DOCUMENTS

| | | | |
|---|---|---|---|
| 2,122,676 | 7/1938 | Bourke | 74/50 |
| 2,122,677 | 7/1938 | Bourke | 123/74 |
| 5,398,508 | 3/1995 | Brown | 60/718 |
| 5,701,062 | 12/1997 | Barrett | 318/51 |
| 5,813,383 | 9/1998 | Cummings | 123/198 F |

*Primary Examiner*—Noah P. Kamen

[57] ABSTRACT

A variable displacement internal combustion engine having a series of at least three cylinders, each having a piston attached to a connecting rod which drives a crankshaft which is common to the three cylinders, wherein the cylinders include a first cylinder, a second cylinder having about twice the capacity of the first cylinder, and a third cylinder having about twice the capacity of the second cylinder, and in which each cylinder may be independently deactivated to allow selected cylinders to operate in an idle mode, whereby the power output of the engine may be widely varied. Preferably, the engine has its cylinders arranged in opposed pairs of first, second, and third cylinders, and also has a pair of fourth cylinders which are each twice the capacity of each third cylinder.

12 Claims, 4 Drawing Sheets

INTERNAL COMBUSTION ENGINE WITH BINARY CYLINDER SIZING FOR VARIABLE POWER OUTPUT

BACKGROUND OF THE INVENTION

1. Field of the Invention

The present invention relates to an internal combustion engine suitable for many uses including motor vehicles, aircraft, boats, etc., and which can provide high efficiency over a large range of power outputs.

2. Prior Art

Internal combustion engines used in vehicles and in boats are required to produce a wide range of power outputs. For example, an automobile operating at high speed, or on hills, may need 10 to 15 times the power required when driving on level city streets. It is not possible to design a conventional engine that has high efficiency over such a wide power range.

There have been suggestions, for example in U.S. Pat. No. 5,398,508, issued Mar. 21, 1995 to Brown, and in patents cited in the Brown patent, for motor vehicles to be provided with an auxiliary or booster engine to increase the power when needed. These auxiliary or booster engines have been separate from the main engine, having a separate crankshaft, which requires clutches or like means to temporarily connect the auxiliary engine to the main engine. Clutches or the like are an undesirable complication, especially if it is desired to continually switch from low power to high power, as will be needed when driving up and down hills. Also, the range of power given by these known arrangements is rather limited.

U.S. Pat. No. 5,701,062, which issued Dec. 23, 1997 to Barrett, refers primarily to problems with electrically driven vehicles, and suggests the use of multiple motors in a binary array, in which each motor has double the power of the next smaller motor, so that a series of motors of 1, 2, 4, 8, and 16 HP may be used. Although this patent has occasional references to "gas engines", these references are all in relation to separate engines, for example one engine driving the front wheels and another the rear wheels, which involve the same problems with clutch or like transmission elements as in the Brown patent.

Neither of these patents suggests a single internal combustion engine having a widely variable power output and which is arranged to avoid possible problems with transmission elements such as clutches.

So-called variable displacement engines have also been designed which are based on conventional engines having cylinders acting on a single crankshaft, and in which some cylinders can be deactivated to reduce the power. Such engines are described for example in U.S. Pat. No. 5,813,383 which issued Sep. 29, 1998 to Cummings. Since these engines are based on conventional engines with cylinders of uniform size, if they were to be designed to provide optimum efficiency over a really wide range of power outputs, for example 10 to 1 or 15 to 1, a large number of cylinders would be required.

SUMMARY OF THE INVENTION

The present invention provides an internal combustion engine which can provide a very wide range of power outputs, while avoiding transmission problems resulting from disconnecting and reconnecting separate engines to a drive train, and which can produce a larger range of power outputs than known variable displacement engines, and does not require a large number of cylinders. The engine can produce widely varying power even when running at constant speed. The use of constant speed is important for efficiency since a particular design of cylinder ports and piston heads only operates at maximum efficiency over a small speed range.

In accordance with one aspect of this invention, an internal combustion engine comprises:

- a series of at least three cylinders, each having a piston attached to a connecting rod which drives a crankshaft, the crankshaft being common to the three cylinders,
- the cylinders including a first cylinder, a second cylinder having about twice the capacity of the first cylinder, and a third cylinder having about twice the capacity of the second cylinder, and
- means for independently deactivating each of said cylinders to allow selected cylinders to operate in an idle mode, whereby the power output of the engine may be adjusted.

The deactivating means, which will be computer controlled, preferably includes means for interrupting the fuel supply to selected cylinders.

In addition, the deactivating means may include a port at the top of each cylinder normally closed by a valve, the valve being opened to connect the cylinder to an air plenum when the cylinder is deactivated. The air plenum may be the atmosphere, but is preferably closed to minimize entry of contaminants. Most conveniently, the engine is a two-stroke engine, and the port closed by this valve is the only port at the top of each cylinder.

Each cylinder of the two stroke engine preferably has an air compression chamber under its piston which is separate from the crankcase, this chamber being connected to an inlet port or ports in the side of the same cylinder. This chamber may also be connectable to the crankcase via a cam-operated valve. Having the air compression chamber separate from the crankcase ensures that crankcase oil does not become contaminated with combustion products.

The first, second, and third cylinders may be parts of first, second, and third stages which each have two or more cylinders of equal size. In a preferred arrangement, each first, second, and third cylinders is one of a pair of opposed cylinders, the cylinders of each pair having the same size and operating on the same crank pin of the crankshaft, the two connecting rods of a pair of opposed cylinders being connected to the crank pin by a scotch yoke. The latter is a yoke which is held for rectilinear movement, for example between the coaxial connecting rods of two opposed pistons, and which has a slideway, perpendicular to its direction of movement, which accommodates the crank pin. The general nature of the opposed cylinder and piston arrangement, and of the scotch yoke, is similar to that shown in U.S. Pat. Nos. 2,112,676 and 2,112,677 of R. L. Bourke.

The invention is not restricted to three sizes of cylinders, or to three sets of opposed cylinders, and in fact a preferred engine for a vehicle has a fourth cylinder, or a pair of fourth cylinders, each fourth cylinder being about twice the capacity of the third cylinder. Additional, larger cylinders could be added, all in a binary series, i.e. with each cylinder having twice the capacity of the next smaller one. Deactivating one or more cylinders can thus give a wide range of power outputs even while engine speed is constant. Preferably, all cylinders have about the same proportions of stroke to bore diameter.

Although the cylinders may be horizontally opposed, it will be understood that references to the "top" of the cylinder, "under" the piston, etc., are made, as is conventional, in relation to a cylinder extending vertically above a horizontal crankshaft.

The engine of this invention may be powered by various fuels including gasoline, diesel fuel, propane, or natural gas.

BRIEF DESCRIPTION OF THE DRAWINGS

A preferred embodiment of the invention will now be described by way of example with reference to the accompanying drawings, in which.

DETAILED DESCRIPTION

Figure 1:
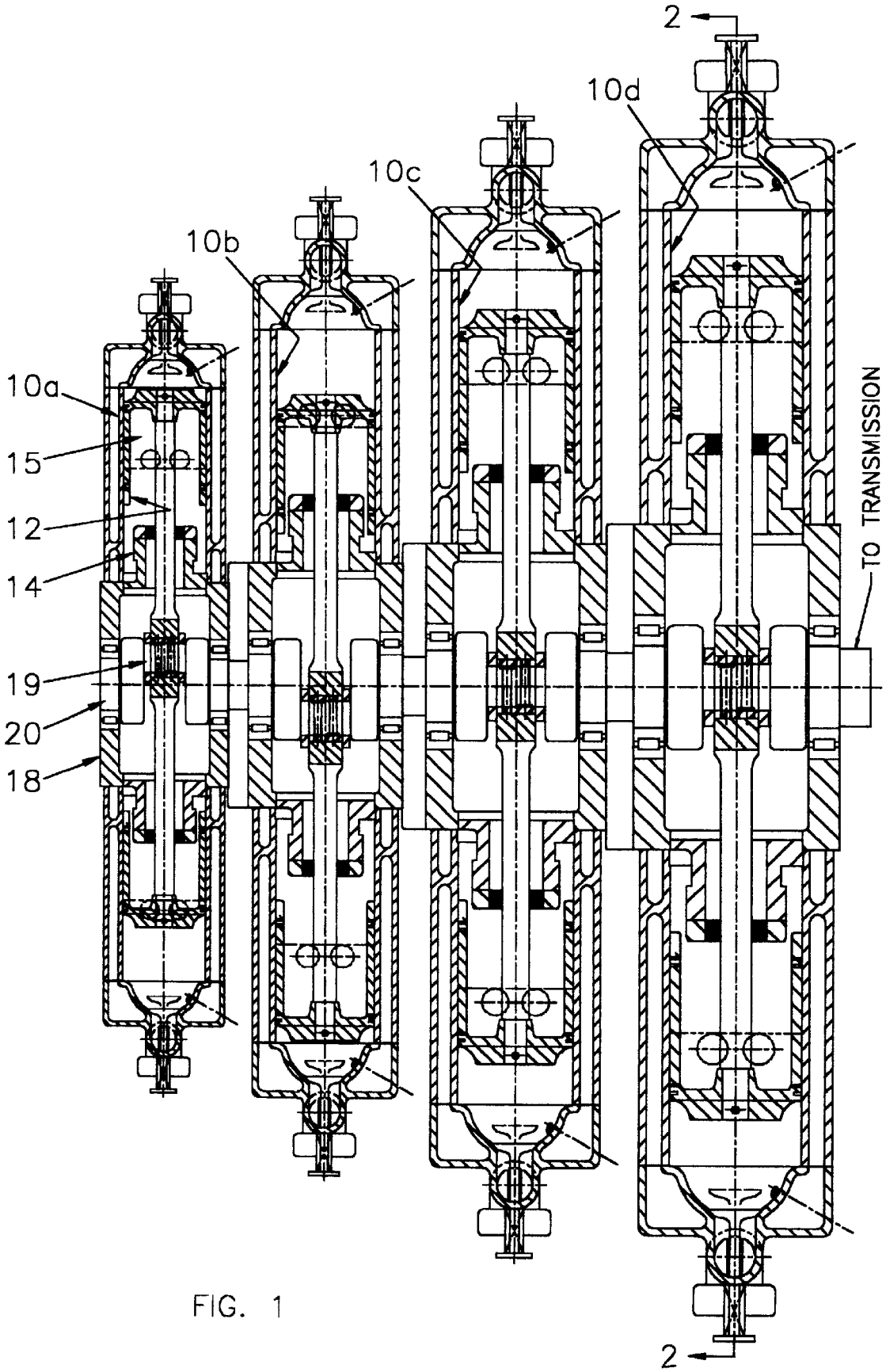
FIG. 1 is a horizontal section through the center of an engine in accordance with this invention.

FIG. 1 shows a two-stroke gasoline engine having four pairs of horizontally opposed cylinders 10*a*, 10*b*, 10*c*, and 10*d* of increasing size. The cylinders have a capacity which increases in a binary fashion, so that each cylinder 10*b* has twice the capacity of a cylinder 10*a*, each cylinder 10*c* has twice the capacity of a cylinder 10*b*, and each cylinder 10*d* has twice the capacity of a cylinder 10*c*. The stages represented by the pairs of cylinders are all of the same design, apart from their dimensions, and all the cylinders have the same proportion of length of stroke to bore diameter. The four stages of the engine are bolted together so that the smaller, most often used stages can easily be replaced.

Each cylinder has a piston 12 with a cylindrical skirt of uniform thickness which slides within the cylinder and move in an annular space defined between the walls of the cylinder and a stationary bushing 14. The bushing has a generally cylindrical outer surface spaced with in the piston skirt so that air can flow from an air compression chamber 15 under the piston to an annular recess 15*a* surrounding the base of the bushing. The head of each piston is connected to an axially extending piston rod/connecting rod 16 (hereinafter "connecting rod") which passes through a seal 17 within the bushing 14; this seal separates the air compression chamber 15 from the crankcase 18.

As seen in FIGS. 2 to 5, each connecting rod 16 drives a crank pin 19 of crankshaft 20 via a scotch yoke 22. The scotch yoke is a conventional part for translating reciprocating motion to rotary motion, and is a rectilinearly moving part solidly connected to the two opposed piston rods 16 and having a rectangular slideway 24 extending perpendicularly to its direction of motion and to the crankshaft axis. The yoke is formed by two symmetrically opposed, lateral extensions 16*a* of the inner ends of the connecting rods, the facing surfaces of which extensions form the slideway, the extensions having outer end portions held spaced apart by spacers 26. Within the slideway is a rectangular sliding block 28 which has two symmetrical portions clamped around the crank pin 19. The yoke provides a convenient arrangement which allows rectilinear motion of the co-axial connecting rods 16 of two opposed cylinders to drive the single crank pin 19.

The annular recess 15*a* provides an inlet for air to be compressed in the chamber 15 and an outlet for the compressed air. The recess connects to a crankcase port 30 arranged to be closed by a valve 32. This valve is normally opened by the difference in air pressure between the crankcase and that under the rising piston, and closed by a spring 32*a*. To produce a proper pressure difference, the crankcase is preferably pressurized by a compressor. The valve 32 is also capable of being held closed, via a rocker 33 and pushrod 34, by a cam 35 on camshaft 35' driven by the crankshaft 20 at the same speed as the latter. It can also be held closed, or almost closed, by a solenoid 36 when it is desired to deactivate the cylinder, as will be described. Recess 15*a* also connects to a pair of parallel inlet air conduits 40 which lead to a pair of side-by-side inlet ports 42 in one side of cylinder 10*d*, and which are uncovered by the piston as it nears its bottom dead center position. A pair of fuel injection orifices 43 are provided in the conduits 40 close to the inlet ports, and each conduit also has a check valve 45 for closing the conduit against pressure of exhaust gases in the cylinder. At the side of the cylinder opposite ports 42 is a pair of exhaust outlet ports 46, slightly larger than ports 42, and which are uncovered by the piston just before the intake port opens. The top of piston 12 is shaped so that fresh intake air entering ports 42 is deflected upwards and is effective to scavenge burnt gases out of ports 46. The ports 46 are connected to exhaust manifold 48. The design of the piston head and the ports is chosen to give very effective purging of the exhaust gases over the small range of speeds for which the engine is designed.

In a two-stroke engine of this type there would normally be no port or valve in the top of the cylinder. However, in this engine a top cylinder port 50 is provided, and this is normally closed by a poppet type valve 52, controlled by a solenoid 53, which is closed when the cylinder is operational. The port 50 is connected by conduit 54 to an air plenum or "idle air reservoir" so that when the cylinder is deactivated air can move freely in and out of the cylinder without bringing in dirt. One side of the top of the cylinder is provided with a spark plug 56, shown in FIG. 6.

Normal operation of one cylinder and piston combination will be described with reference to the upper cylinder 10*d* shown in FIGS. 2 to 5; the operation of all piston and cylinder combinations being identical. This normal operation occurs with valve 52 closed, and solenoid 36 not operational.

Figure 2:
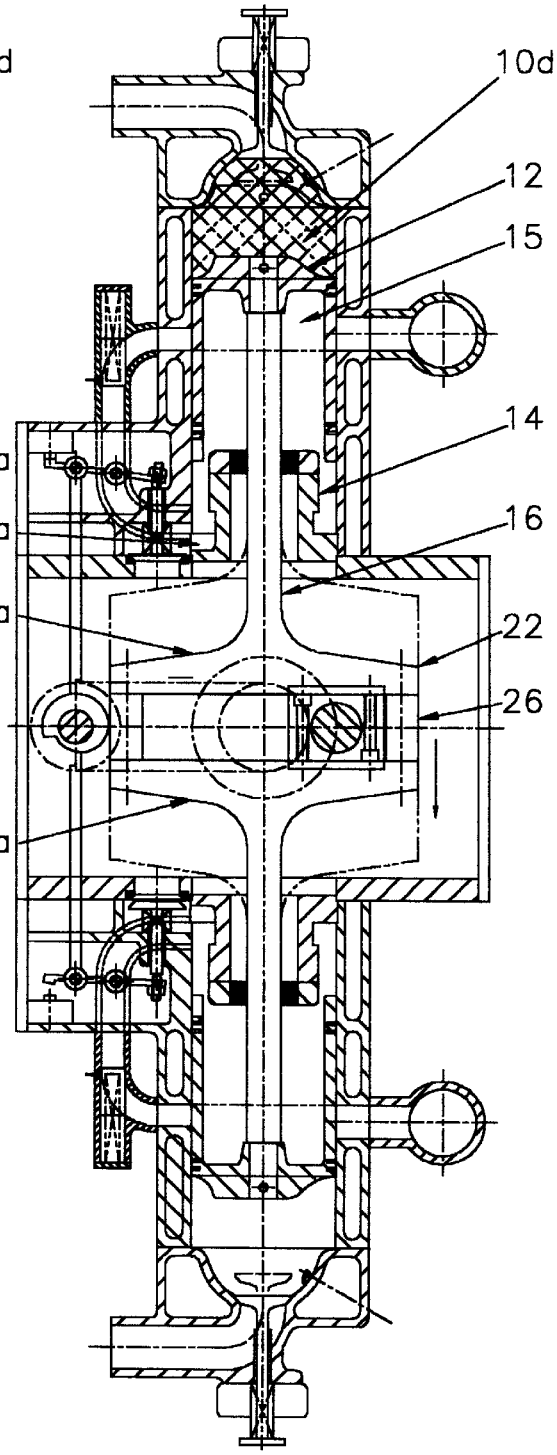
FIG. 2 is a vertical section through one pair of cylinders of the engine, on lines 2—2 of FIG. 1.

FIG. 2 shows the piston being driven down the cylinder by exploding gases, while the piston still covers the ports 42 and 46, with the connecting rod 16 driving the crank 19. This movement of the piston compresses air in the chamber 15 under the piston, pushing this into the recess 15*a* and into the conduits 40, while the closed valve 32 prevents air escaping through the port 30.

Figure 3:
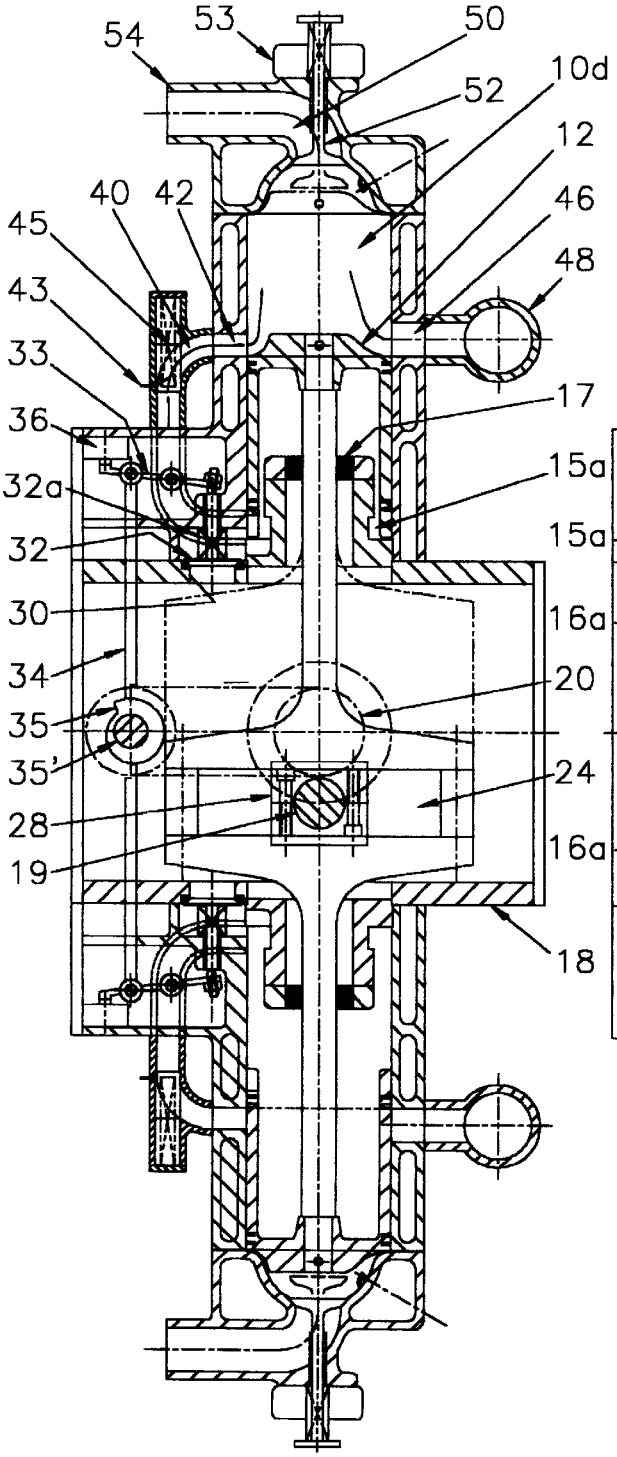
FIG. 3 is a view similar to FIG. 2 with the crankshaft at a second position.

As the piston moves further down towards the FIG. 3 position, it firstly uncovers the upper portion of exhaust ports 46 allowing some of the burnt gases to escape. Soon afterwards, the piston nears the bottom dead center position (FIG. 3) and uncovers the inlet ports 42; backflow of exhaust gases and fuel being prevented by check valves 45. As the pressure in the cylinder drops, the check valves open to allow air compressed into recess 15*a* and conduits 40 to enter the cylinder. At the same time, the injector 43 injects a charge of fuel into the air which is entering the cylinder.

Figure 4:
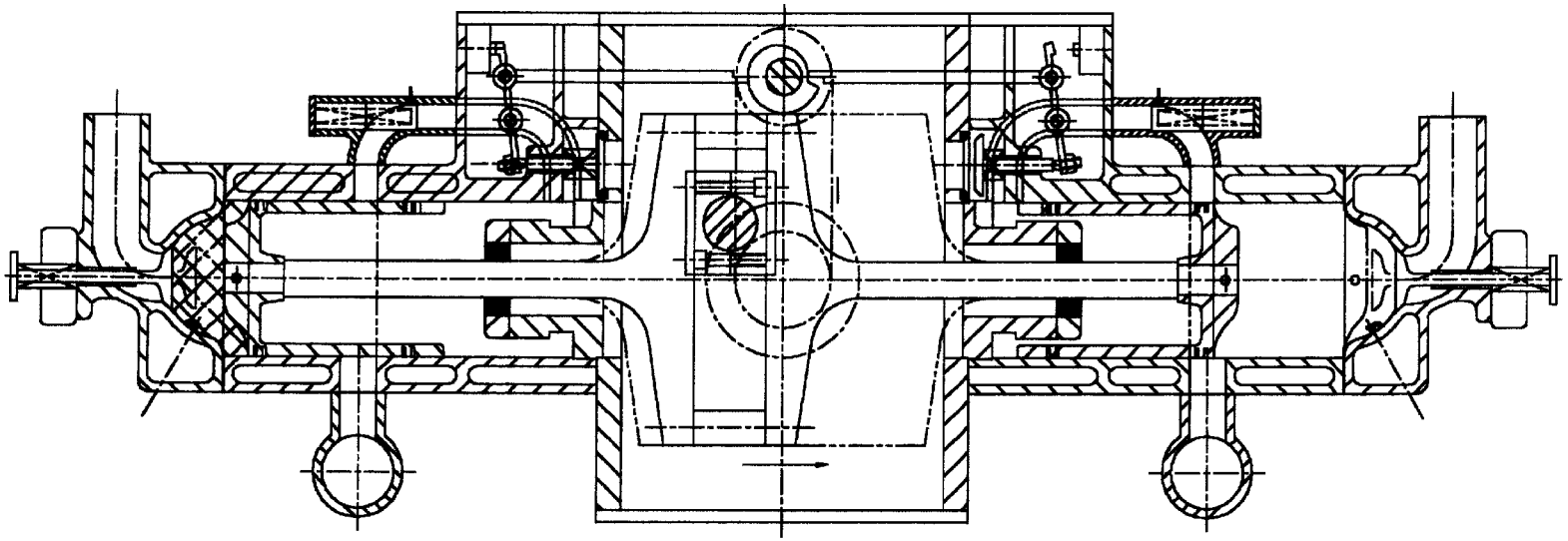
FIG. 4 is a view similar to FIG. 3 with the crankshaft at a third position.

FIG. 4 shows the position when the crank pin 19 has moved 45° beyond the FIG. 3 position. The cylinder has risen enough to close the inlet ports 42, and has almost closed the outlet ports 46. After a small amount of further movement all these ports are closed and the air/fuel mixture is compressed in the top of the cylinder. The cam 35 has just released the pushrod 34 allowing slightly pressurized air in the crankcase to open the valve 32, so that the recess 15*a* and chamber 15 now communicate with the air inside the crankcase, and air is being forced into this chamber as the piston rises.

Figure 5:
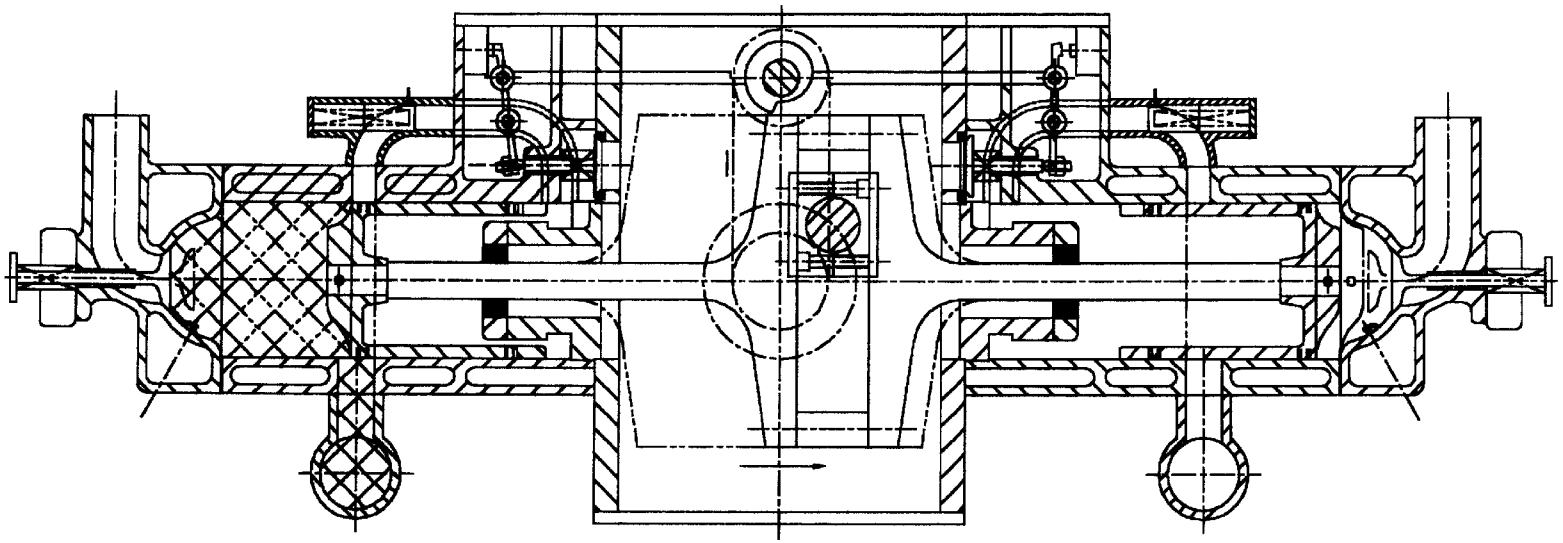
FIG. 5 is a view similar to FIG. 4 with the crankshaft at a fourth position.

FIG. 5 shows the next position, when the piston is approaching the top dead center, and the air/fuel mixture has been compressed. Since almost a full charge of combustion air has been pulled into the chamber 15, the cam 35 is starting to close the valve 32. As the cylinder nears top dead center, ignition occurs and the parts move again to the FIG. 2 position, completing the cycle.

Figure 6:
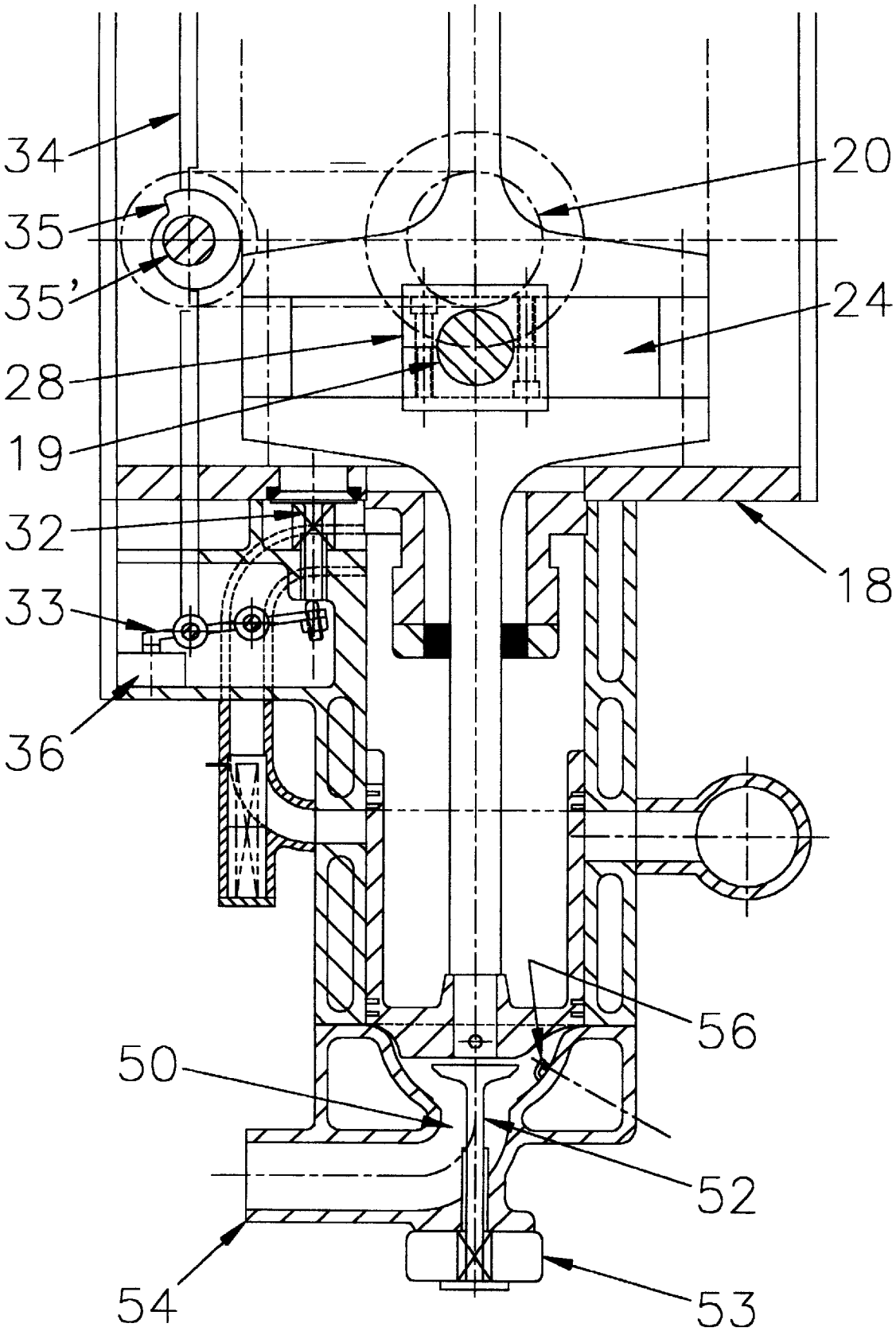
FIG. 6 is an enlarged vertical sectional view through part of one cylinder, showing the valves in an idle state in which the cylinder is deactivated.

FIG. 6 shows the situation when it is desired to deactivate a pair of cylinders. The solenoids 36 and 53 are activated sequentially, and the supply of fuel to the injector 43 is interrupted. The solenoid 36 holds the valve 32 mostly closed, while air is still allowed to move between the compression chamber under the piston and the conduits 40. The solenoid 53 opens the valve 52 so that the cylinder is open to the air plenum 54, minimizing the resistance to movement of the air in the cylinder.

Starting this engine does not require a large starter motor because it can easily be rotated at 1,000 rpm when all cylinders are deactivated and not compressing air, at which stage the small cylinders can be activated to start this first stage using inertia to supplement the starting motor. The larger cylinders can then be started in stages. This is highly significant since it allows a large engine to be started, even in cold weather, by a small starter and small batteries, etc.

Warming up the engine is simple because the energy from the smallest stage can heat up all the engine cooling fluid which can then be pumped to heat all the cylinders. Intermittent pulsing of all cylinders could help with warming-up.

Lubrication of the crankshaft bearings, scotch yoke, connecting rods, etc. is accomplished mainly by oil splashing in the crankcase; space is provided between the crankcase roller bearings for oil to flow, as well as vent holes in the adjacent crankcase walls. The piston skirts can be lubricated through an oil supply conduit in the connecting rod and cross-holes in the piston. Since valve 32 and check valve 45 separates the crankcase from the cylinder, the crankcase oil is not contaminated with combustion impurities, which results in long life.

A suitable small vehicle engine of this design might have its four stages producing respectively 5, 10, 20 and 40 HP. The different stages can be selectively deactivated, under computer control, to provide different combinations of these power outputs, i.e. 5, 10, 15, 20, 25, 30, 35, 40, 45, 50, 55, 60, 65, 70, and 75 HP. For optimum efficiency, an automatic transmission system is used so that the engine operates continuously at close to its optimum and most efficient speed.

I claim:

1. An internal combustion engine comprising:

a series of at least three cylinders, each having a piston attached to a connecting rod which drives a crankshaft, said crankshaft being common to the three cylinders, wherein the cylinders include a first cylinder, a second cylinder having about twice the capacity of the first cylinder, and a third cylinder having about twice the capacity of the second cylinder, and means for independently deactivating each of said cylinders to allow selected cylinders to operate in an idle mode, whereby the power output of the engine may be adjusted.

2. An engine according to claim 1, wherein the deactivating means includes means for interrupting the fuel supply to selected cylinders.

3. An engine according to claim 1, wherein the means for deactivating includes a port at the top of each cylinder normally closed by a valve, said valve being opened to connect the cylinder to an air plenum when the cylinder is deactivated.

4. An engine according to claim 3, wherein the engine is a two-stroke engine, and wherein said valve is the only port at the top of each cylinder.

5. An engine according to claim 1, having a fourth cylinder which is about twice the capacity of the third cylinder.

6. A two-stroke internal combustion engine comprising:

a series of at least three cylinders, each having a piston with a connecting rod connected driving a crankshaft which is common to the three cylinders, wherein the cylinders include a first cylinder, a second cylinder having about twice the capacity of the first cylinder, and a third cylinder having about twice the capacity of the second cylinder, each cylinder having a side inlet port arranged to be fully uncovered by its piston when the piston is in bottom dead center position and having an exhaust port partially uncovered by the piston prior to the uncovering of the intake port when close to the bottom dead center position, the inlet port being connected to a fuel supply, each cylinder also having a port at its top end normally closed by a valve capable of being opened to connect the port to an air plenum, said valve being a part of means for independently deactivating each of said cylinders to allow selected cylinders to operate in an idle mode, whereby the power output of the engine may be adjusted for a predetermined engine speed.

7. An engine according to claim 6, wherein the deactivating means includes means for interrupting the fuel supply to selected cylinders.

8. An engine according to claim 6, wherein said first, second, and third cylinders are each one of a pair of opposed cylinders, the cylinders of each pair having the same size and operating on the same crank pin of the crankshaft.

9. An engine according to claim 8, wherein the two connecting rods of a pair of opposed cylinders are connected to the same crank by a scotch yoke.

10. An engine according to claim 8, having a pair of fourth cylinders each being about twice the capacity of the third cylinders.

11. An engine according to claim 6, wherein said means for deactivating include a solenoid valve controlling flow of combustion air into a space in each cylinder below the piston.

12. An engine according to claim 6, having a fourth cylinder which is about twice the capacity of the third cylinder.

* * * * *